US006212713B1

(12) United States Patent
Kuck et al.

(10) Patent No.: US 6,212,713 B1
(45) Date of Patent: Apr. 10, 2001

(54) EXAMINATION TABLE WITH SLIDING BACK SECTION

(75) Inventors: Jay L. Kuck, St. Marys; Paul P. Kolada, Bexley; Sean W. Svendsen, Columbus, all of OH (US)

(73) Assignee: Midmark Corporation, Versailles, OH (US)

( * ) Notice: Subject to any disclaimer, the term of this patent is extended or adjusted under 35 U.S.C. 154(b) by 0 days.

(21) Appl. No.: 09/371,053

(22) Filed: Aug. 9, 1999

(51) Int. Cl.[7] ..... A47C 7/015; A47C 7/018; A47C 13/08

(52) U.S. Cl. ..... 5/617; 5/618; 297/354.13; 297/411.39

(58) Field of Search ..... 5/618, 613, 616, 5/617; 297/354.13, 343, 411.39

(56) References Cited

U.S. PATENT DOCUMENTS

| | | |
|---|---|---|
| 1,398,203 | 11/1921 | Schmidt . |
| 1,658,736 | 2/1928 | Ortmeier . |
| 2,500,742 | 3/1950 | Taylor . |
| 2,913,300 | 11/1959 | Darnell et al. . |
| 3,220,021 | 11/1965 | Nelson . |
| 3,220,022 | 11/1965 | Nelson . |
| 3,233,255 | 2/1966 | Propst . |
| 3,242,507 | 3/1966 | Peterson . |
| 3,261,639 | 7/1966 | Phillips . |
| 3,281,141 | 10/1966 | Smiley et al. . |
| 3,406,772 | 10/1968 | Ahrent et al. . |
| 3,581,320 | 6/1971 | Degen . |
| 3,593,350 | 7/1971 | Knight et al. . |
| 3,644,946 | 2/1972 | Swatt . |
| 3,686,696 | 8/1972 | Lanigan . |
| 3,693,200 | 9/1972 | Stafford . |
| 3,793,652 | 2/1974 | Linehan et al. . |
| 3,821,821 | 7/1974 | Burst et al. . |
| 3,898,702 | 8/1975 | Goodman . |
| 3,919,727 | 11/1975 | Paine . |
| 3,965,500 | 6/1976 | Stein, Jr. . |
| 4,005,497 | 2/1977 | Sutter . |
| 4,057,240 | 11/1977 | Damico et al. . |
| 4,095,296 | 6/1978 | Ferro . |
| 4,097,940 | 7/1978 | Tekulve et al. . |
| 4,127,906 | 12/1978 | Zur . |
| 4,139,917 | 2/1979 | Fenwick . |
| 4,183,109 | 1/1980 | Howell . |
| 4,218,788 | 8/1980 | Steckmesser . |
| 4,225,988 | 10/1980 | Cary et al. . |
| 4,227,269 | 10/1980 | Johnston . |
| 4,307,477 | 12/1981 | Jacobsen . |
| 4,312,500 | 1/1982 | Janssen . |
| 4,336,621 | 6/1982 | Schwartz . |
| 4,361,917 | 12/1982 | Wilson . |
| 4,371,996 | 2/1983 | Nahum . |
| 4,376,316 | 3/1983 | Mercier et al. . |
| 4,380,838 | 4/1983 | Lutchansky . |
| 4,381,571 | 5/1983 | Elliott . |
| 4,385,410 | 5/1983 | Elliott et al. . |
| 4,407,030 | 10/1983 | Elliott . |
| 4,409,695 | 10/1983 | Johnston et al. . |
| 4,411,035 | 10/1983 | Fenwick . |

(List continued on next page.)

*Primary Examiner*—Alexander Grosz
(74) *Attorney, Agent, or Firm*—Biebel & French

(57) ABSTRACT

An examination table including a base member supporting a seat section and including a back section pivotally supported on the seat section. The back section includes an elongated pivot frame connected to the seat section at a pivot connection, and a sliding frame supported for longitudinal sliding movement along the pivot frame. A coupling member is supported on the pivot frame for rotational movement and includes telescoping members engaged with the sliding frame wherein the coupling member is rotated by a linkage during pivotal movement of the back section to cause the sliding frame to move longitudinally of the pivot frame to accommodate movement of a patient's back relative to the pivot frame as the pivot frame is pivoted.

17 Claims, 7 Drawing Sheets

U.S. PATENT DOCUMENTS

| | | | | |
|---|---|---|---|---|
| 4,494,259 | | 1/1985 | Miller et al. . | |
| 4,527,298 | | 7/1985 | Moulton . | |
| 4,558,857 | | 12/1985 | Heller . | |
| 4,559,655 | | 12/1985 | Peck . | |
| 4,559,656 | | 12/1985 | Foster . | |
| 4,572,573 | | 2/1986 | Yoshikawa et al. . | |
| 4,592,104 | | 6/1986 | Foster et al. . | |
| 4,637,652 | | 1/1987 | Bergenwall . | |
| 4,655,471 | * | 4/1987 | Peek | 297/DIG. 4 |
| 4,674,140 | | 6/1987 | Boonants et al. . | |
| 4,711,486 | | 12/1987 | Fujiyama . | |
| 4,742,586 | | 5/1988 | Galumbeck . | |
| 4,751,754 | | 6/1988 | Bailey et al. . | |
| 4,839,932 | | 6/1989 | Williamson . | |
| 4,847,929 | | 7/1989 | Pupovic . | |
| 4,862,529 | | 9/1989 | Peck . | |
| 4,893,365 | | 1/1990 | Justice . | |
| 4,894,876 | | 1/1990 | Fenwick . | |
| 4,899,404 | | 2/1990 | Galumbeck . | |
| 4,937,900 | | 7/1990 | Bridges . | |
| 4,944,055 | | 7/1990 | Shainfeld . | |
| 4,996,731 | | 3/1991 | Kruyt . | |
| 5,072,463 | | 12/1991 | Willis . | |
| 5,129,117 | | 7/1992 | Celestina et al. . | |
| 5,160,010 | | 11/1992 | Peterson . | |
| 5,165,129 | | 11/1992 | Rohm . | |
| 5,181,762 | * | 1/1993 | Beumer | 297/358 |
| 5,195,198 | | 3/1993 | Travis . | |
| 5,205,004 | | 4/1993 | Hayes et al. . | |
| 5,224,228 | | 7/1993 | Larrimore . | |
| 5,245,718 | | 9/1993 | Krauska . | |
| 5,279,010 | | 1/1994 | Ferrand et al. . | |
| 5,315,726 | | 5/1994 | Borenstein . | |
| 5,329,657 | | 7/1994 | Bartley et al. . | |
| 5,398,357 | | 3/1995 | Foster . | |
| 5,404,604 | | 4/1995 | Has et al. . | |
| 5,454,126 | | 10/1995 | Foster et al. . | |
| 5,537,701 | | 7/1996 | Elliott . | |
| 5,790,997 | | 8/1998 | Ruehl | 5/618 |
| 5,823,621 | * | 10/1998 | Broadhead | 297/456.13 |

* cited by examiner

EXAMINATION TABLE WITH SLIDING BACK SECTION

BACKGROUND OF THE INVENTION

The present invention relates generally to articulated examination tables and, more particularly, to an articulated examination table for positioning a patient between a supine position and a generally upright sitting position.

Articulated examination tables are well known in the prior art, and provide for positioning of a patient to a variety of different positions which may be selected in accordance with the particular procedure being performed and with reference to the preferences of the particular operator or surgeon. In particular, it is known to provide a seat section for supporting a patient and a pivoted back section movable relative to the seat section to position the upper torso of a patient at a desired orientation relative to the horizontal wherein the back section may be actuated for movement by an electrical or hydraulic actuator.

A recognized problem associated with tables having pivoted back sections is shear movement between the back section of the table and the patient's back as the back section is pivoted. This typically requires that the patient reposition his or her back along the back section during the pivotal movement in order to accommodate the relative movement between the table surface and the patient.

U.S. Pat. No. 5,790,997 to Ruehl discloses a table having an articulated deck wherein articulation of the deck includes movement of the deck sections relative to each other to match the expansion and contraction of the skin of a person supported on the deck. This device requires that the movement of the deck sections relative to each other coincide with a vertical movement of the articulated deck, such that movement of the deck sections relative to each other independent of the vertical movement is not accommodated.

Accordingly, there is a continuing need for an examination table capable of comfortably supporting a patient during pivotal movement of a table back section relative to a table seat section. Further, there is a need for such a table incorporating a simple mechanism for providing relative movement between a table back and seat section during pivotal movement of the back section.

SUMMARY OF THE INVENTION

The present invention provides an examination table including a base member, a seat section supported on the base member, and a back section including an elongated pivot frame and a sliding frame slidably supported on the pivot frame. A hinge connection connects the pivot frame to the seat section for movement of the back section from a substantially horizontal position, parallel to the seat section, to an inclined position.

A coupling member is supported on the pivot frame and includes a first portion connected to the sliding frame and a second portion connected to the seat section. The coupling member is supported for rotational movement about a pivot point on the pivot frame. Pivotal movement of the back section about the hinge connection causes rotation of the coupling member relative to the pivot frame, and thereby causes the sliding frame to move longitudinally along the pivot frame.

More particularly, the first and second portions of the coupling member define spaced members extending radially outwardly from the pivot point, and the first portion comprises a telescoping member extending between the pivot point and the sliding frame. One end of an elongated linkage rod is connected to a distal or radially outer end of the second portion and an opposite end of the linkage rod is connected to the seat section. Thus, the linkage rod operates as an anchoring structure extending to the coupling member to cause the rotational movement of the coupling member during movement of the back section.

The back section is actuated for movement by a linear actuator located within the seat section wherein the linear actuator extends between the seat section and the pivot frame for the back section. Actuation of the linear actuator causes pivotal movement of the back section relative to the seat section and simultaneous movement of the sliding frame relative to the pivot frame. In addition, a pair of arm rests are supported on the coupling member and are actuated for rotational movement about the pivot point of the coupling member at the same time that the back section is actuated for pivotal movement whereby the arm rests are maintained in a substantially horizontal orientation throughout movement of the back section.

Therefore, it is an object of the present invention to provide an examination table which accommodates the longitudinal movement of a patient's back during pivotal movement of a back section of the table relative to a seat section.

It is another object of the invention to provide an examination table which includes a back section pivotal relative to a seat section and including a sliding member on the back section for longitudinal movement relative to a pivoted frame of the back section.

Other objects and advantages of the invention will be apparent from the following description, the accompanying drawings and the appended claims.

DETAILED DESCRIPTION OF THE PREFERRED EMBODIMENT

Figure 1:
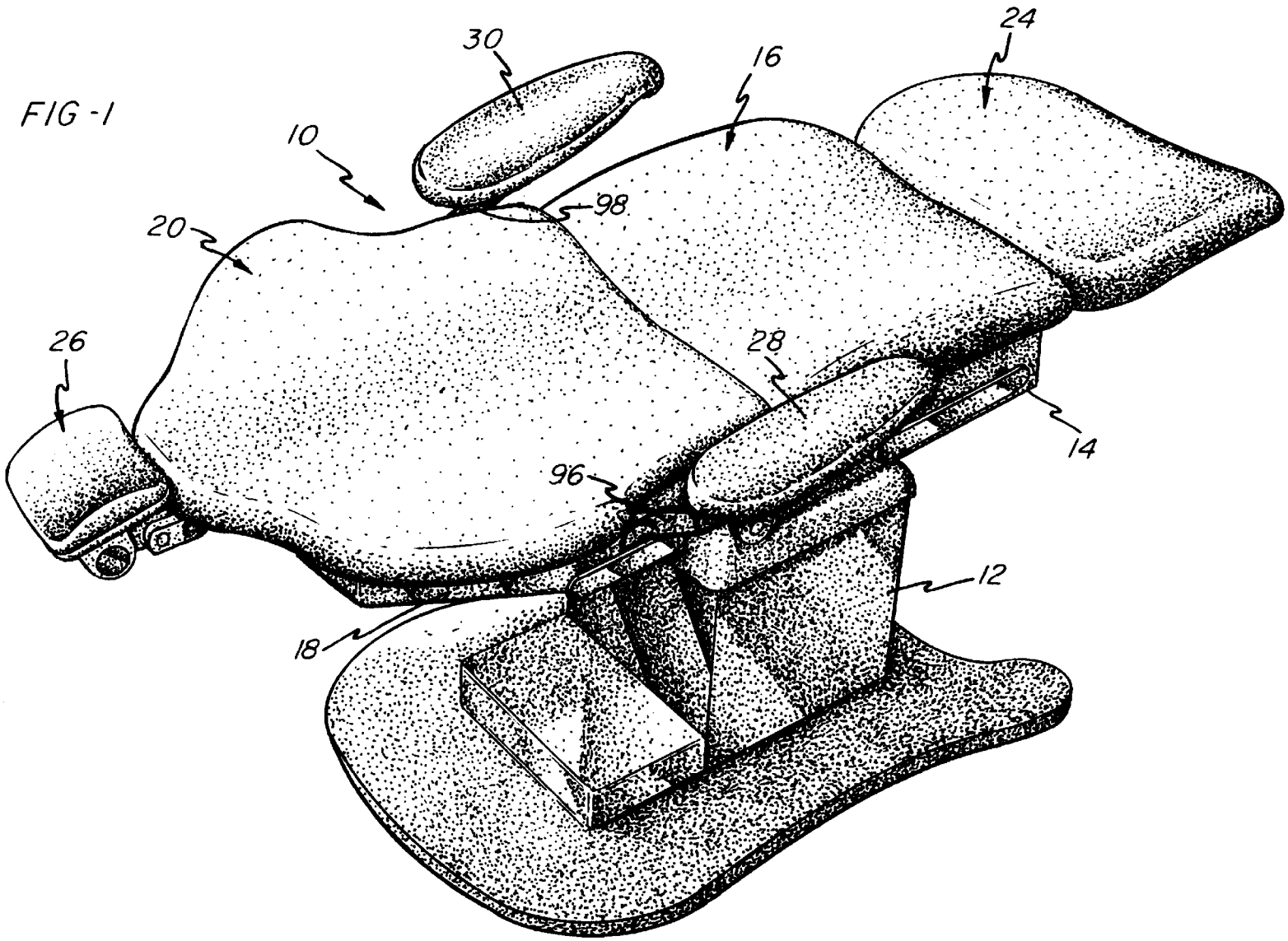
FIG. 1 is a perspective view of the examination table of the present invention configured to support a patient in a supine position.
Figure 2:
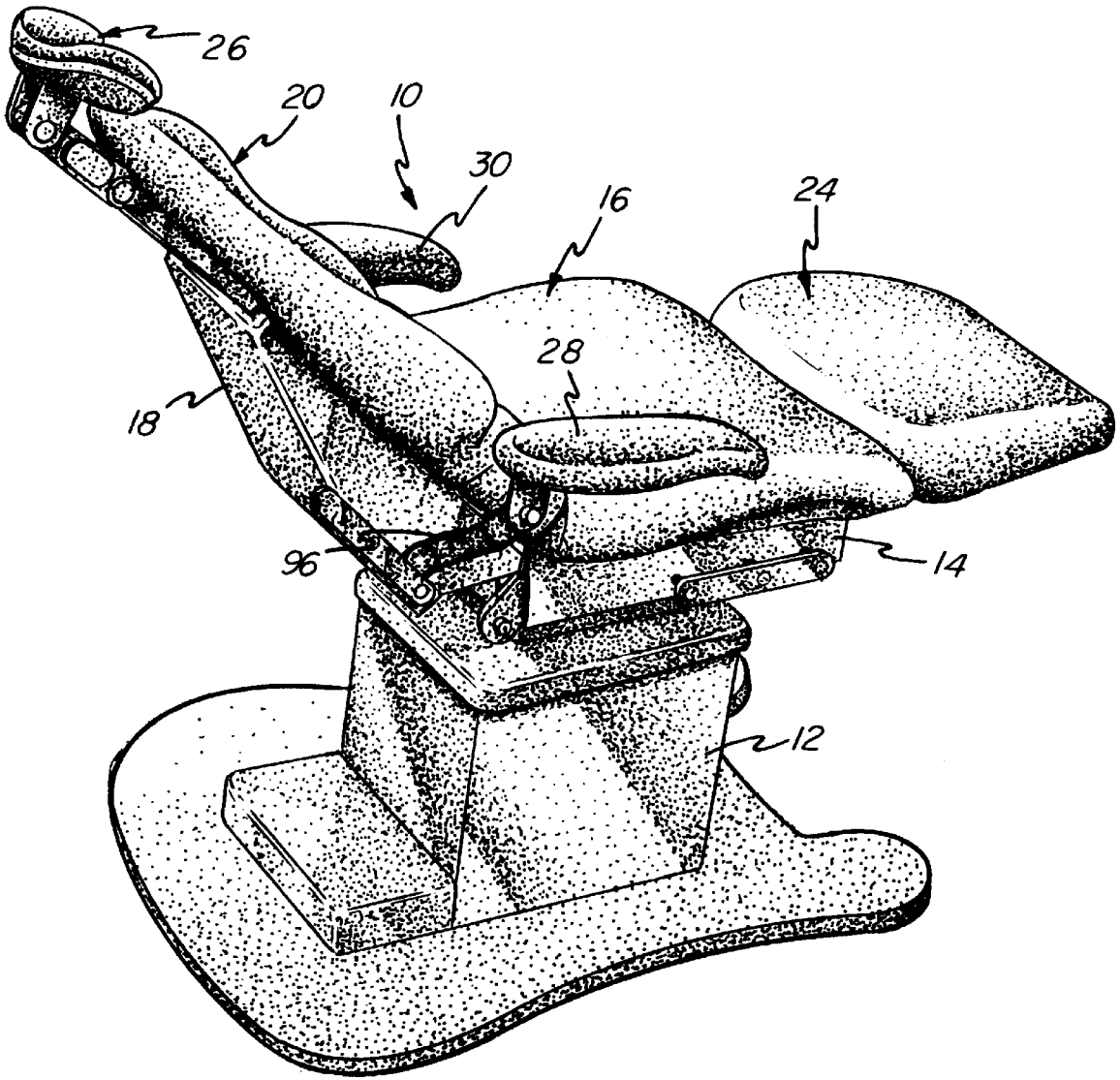
FIG. 2 is a perspective view of the examination table configured to support a patient with the back in a partially inclined position.
Figure 3:
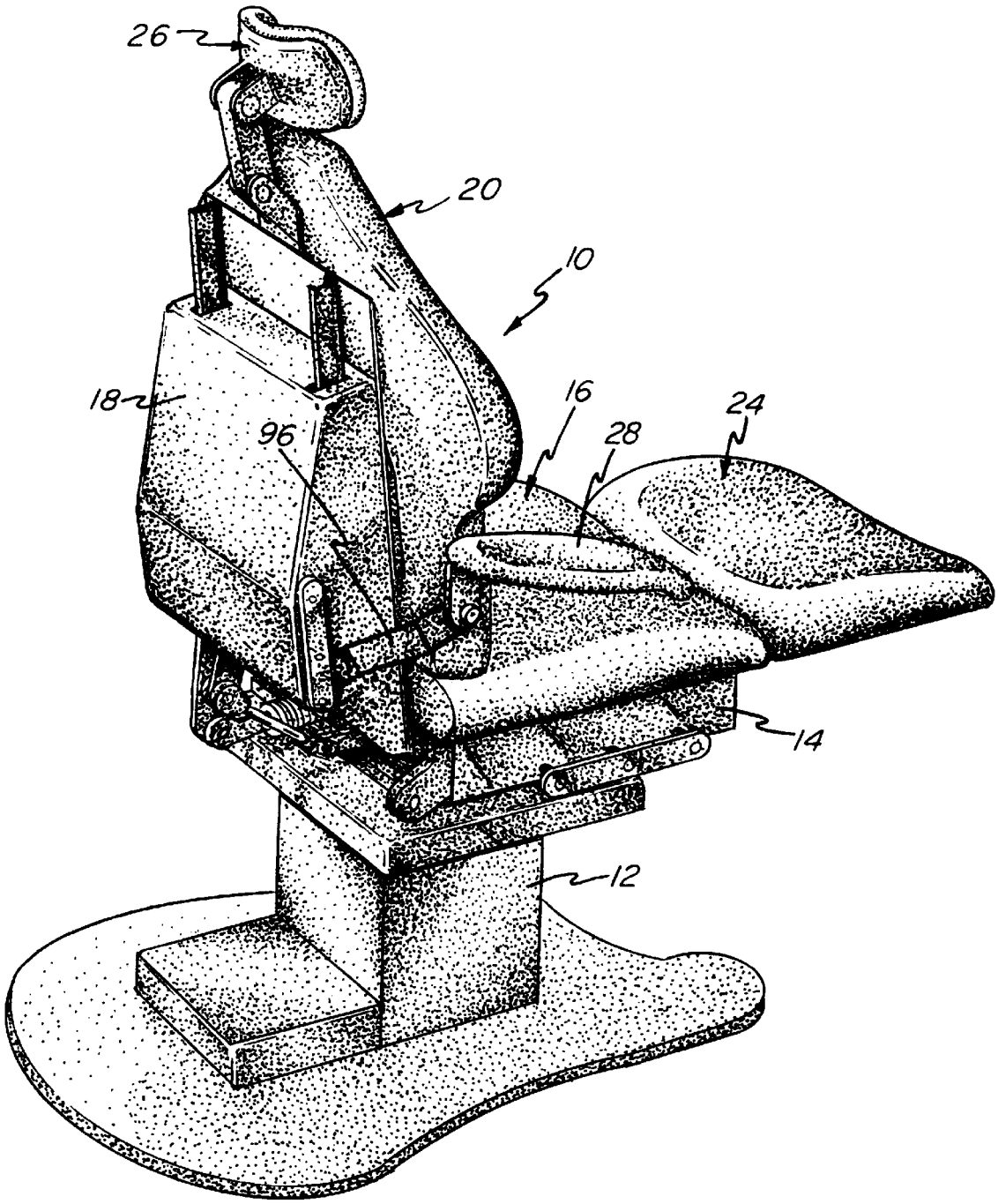
FIG. 3 is a perspective view of the examination table configured to support a patient with the back in an upright position.

Referring initially to FIGS. 1–3, the examination table 10 of the present invention includes a base member 12 defining an upwardly extending pedestal structure for supporting the examination table 10 on a floor surface. The base member 12 supports a frame 14 for a seat section 16. The frame 14 supports a pivot frame 18 for a back section 20, and further supports a leg section 24. The seat section 16, back section 20 and leg section 24 define a patient support surface for the examination table 10. In addition, the back section 20 supports a head rest 26 extending above the back section 20 for supporting a patient's head, and a pair of arm rests 28, 30 are also supported on the back section 20 and located to either side thereof extending toward the sides of the seat section 16.

Figure 4:
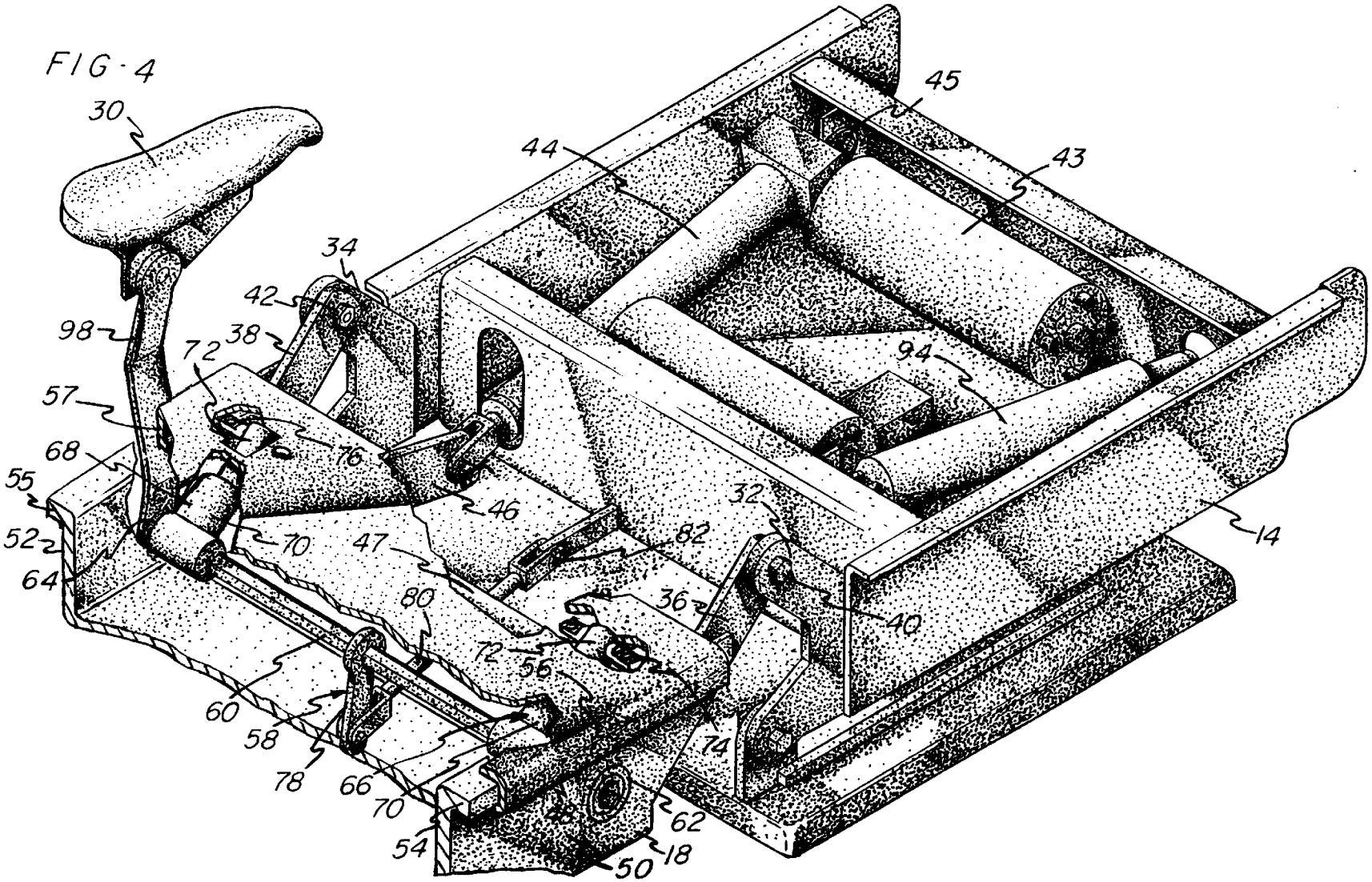
FIG. 4 is a perspective, partially cut away view showing the seat section and a portion of the back section.

Referring to FIG. 4, the connection between the seat section 16 and the back section 20 is illustrated with the seat section and back section cushions removed to expose the respective seat and back section frames 14, 18. The frame 14 includes a pair of hinge connection extensions 32 and 34, and the frame 18 includes a pair of pivot extensions 36 and 38 rigidly attached to the frame 18 and connected to the hinge connection extensions 32, 34 by means of respective pivot pins 40 and 42. The pins 40, 42 support the back section 20 for pivotal movement through the frame 18 such that the frame 18 comprises a pivot frame for the back section 20. The frame 18 is driven in pivotal movement by a linear actuator 44, such as an actuator powered by an electric motor 43, which extends between a mounting point 45 on the seat frame 14 and a drive extension 46 rigidly attached to the pivot frame 18 at junction member 47 (see also FIG. 5). Extension of the linear actuator 44 causes the pivot frame 18 to pivot upwardly toward an upright sitting position for the back section 20.

A sliding frame 48 is supported on an upper portion of the pivot frame 18 for longitudinal sliding movement relative to the pivot frame 18. The pivot frame 18 includes a pair of side walls 50, 52, each with an out turned flange 54, 55. The outer edges 56, 57 of the sliding frame 48 extend around the out turned flanges 54, 55 for guiding the sliding frame 48 in longitudinal sliding movement along the pivot frame 18.

The sliding frame 48 is actuated for sliding movement by a coupling member 58 comprising a rotatable shaft 60 supported in bearings 62, 64 associated with the side walls 50, 52, respectively. A pair of telescoping members 66, 68, defining first portions of the coupling member 58 are mounted to the shaft 60 for rotation therewith. Each of the telescoping members 66, 68 comprises an outer tubular member 70 and an inner slide member 72 which is freely slidable within the outer tubular member 70. The ends of the inner slide members 72 distal from the shaft 60 are attached to the sliding frame 48 at connections 74, 76 which permit rotation of the telescoping members 66, 68 relative to the slide frame 48.

The coupling member 58 further includes a second portion 78 formed by an elongated arm attached to the shaft 60 for rotation therewith wherein the second portion 78 is circumferentially spaced from the telescoping members 66 and 68, and an end of the second portion 78 distal from the rotatable shaft 60 is attached to a linkage rod 80 which extends to a hinged connection point 82 on the seat frame 14.

Figure 5:
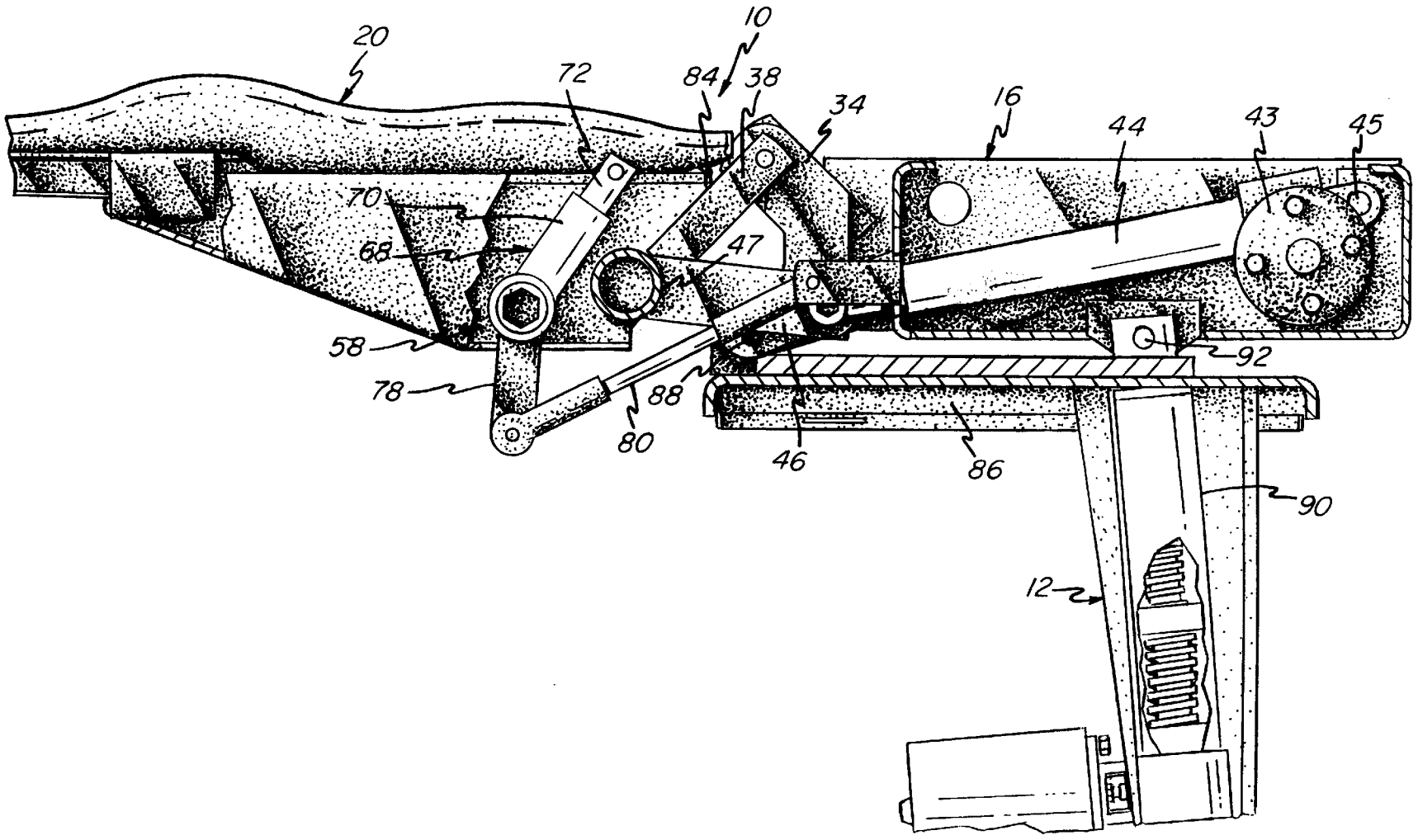
FIG. 5 is a side elevational view in partial cross-section illustrating the examination table in the position illustrated in FIG. 1.
Figure 6:
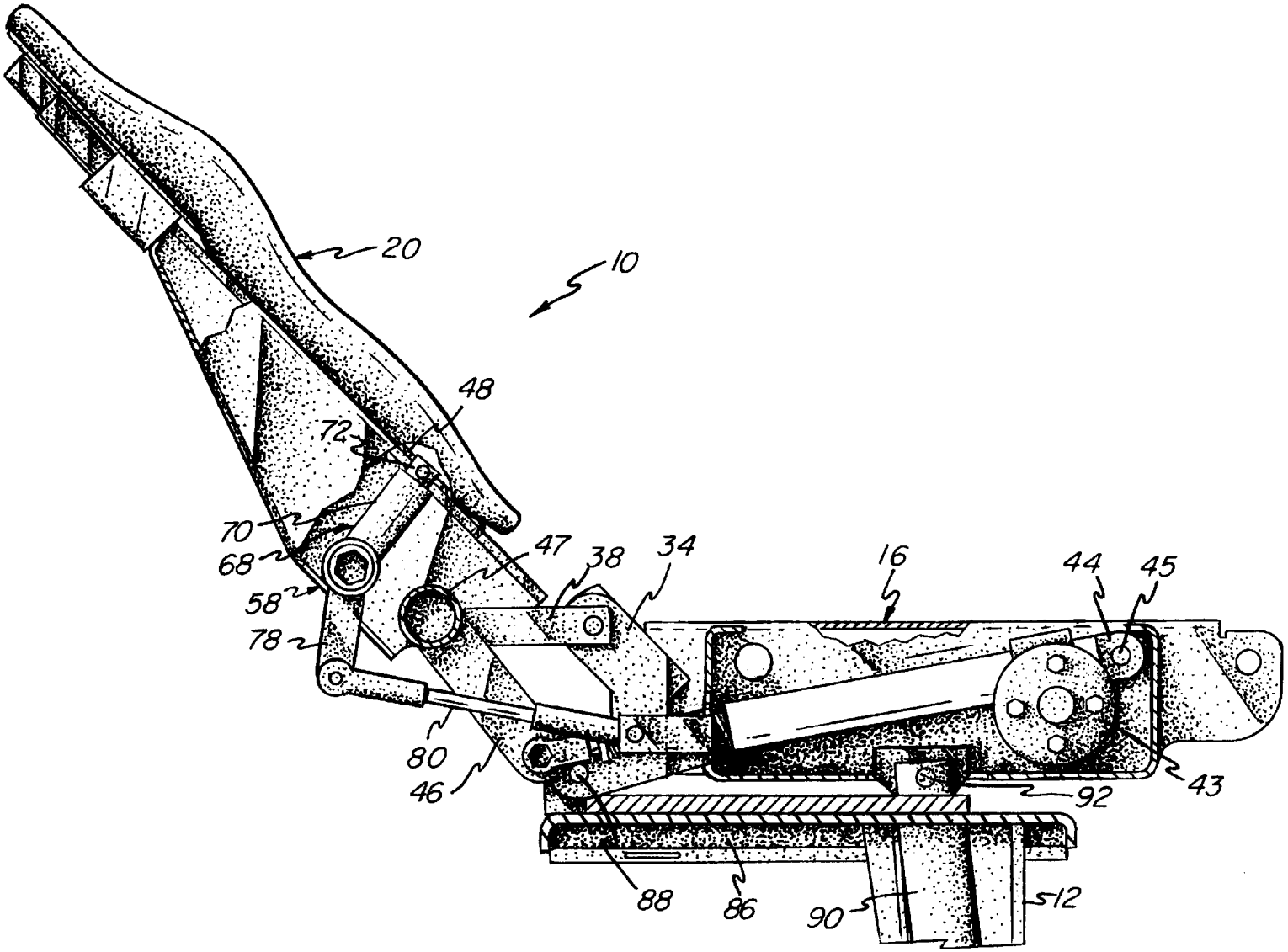
FIG. 6 is a side elevational view in partial cross-section illustrating the examination table in the position shown in FIG. 2.
Figure 7:
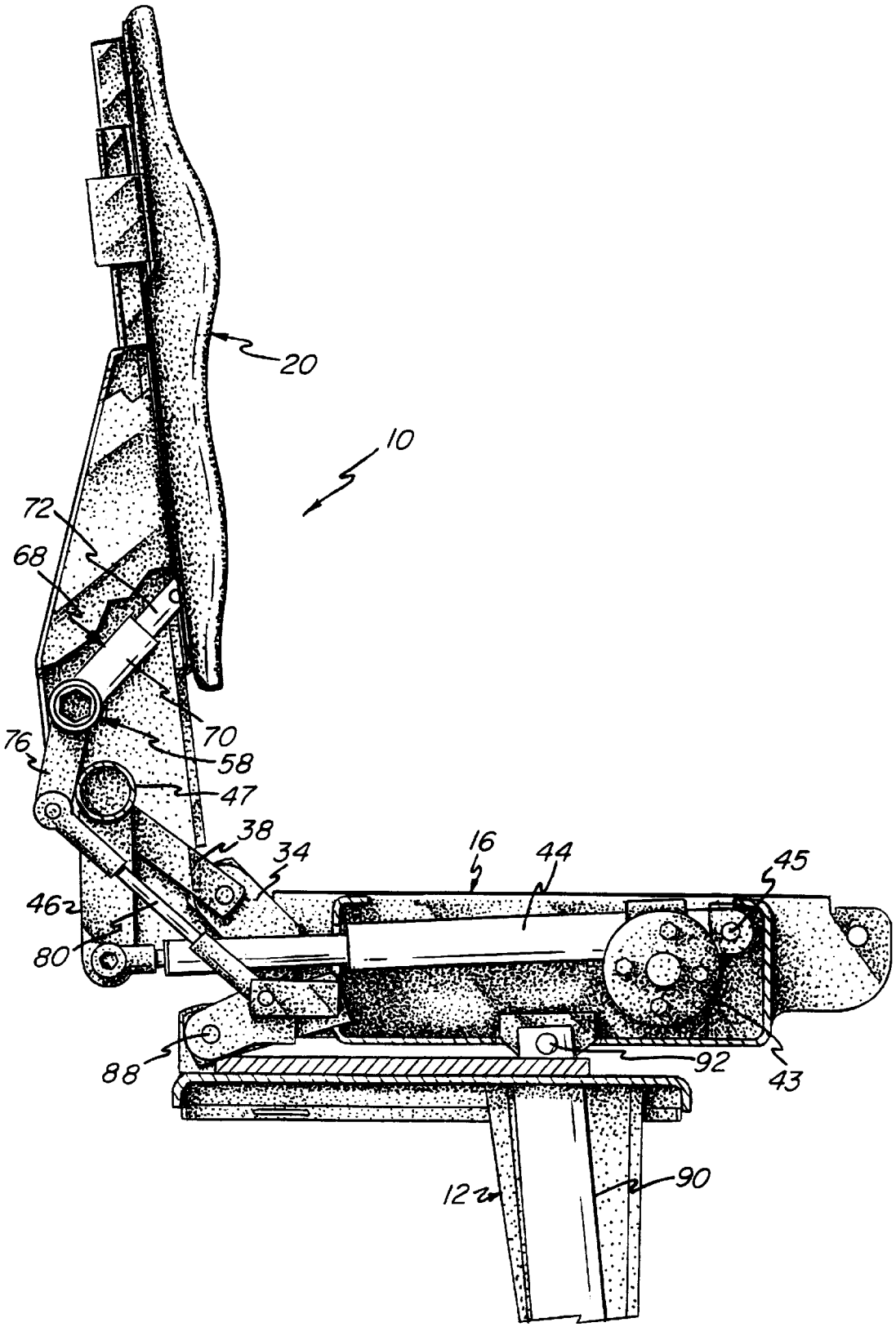
FIG. 7 is a side elevational view in partial cross-section illustrating the examination table in the position shown in FIG. 3.

Referring to FIGS. 5–7, alternative positions of the back section 20 relative to the seat section 16 are shown to illustrate the operation of the coupling member to move the sliding frame 48 relative to the pivot frame 18. In particular, FIG. 5 illustrates the back section 20 in a substantially horizontal position parallel to the seat section for supporting a patient in a supine position. In this position, the telescoping members 66, 68 are angled toward the seat section 16 as a result of the linkage rod 80 biasing the second portion 78 of the coupling member 58 forwardly toward the head end of the back section 20. It can be seen that the inner members 72 of the telescoping members 66, 68 are extended outwardly from the outer member 70 to position the sliding frame 48 such that a lower edge 84 thereof is positioned closely adjacent to the seat section 16.

FIG. 6 shows the back section 20 in a partially inclined position. It can be seen that the linkage rod 80 has caused the second portion 78 of the coupling member 58 to pivot in a direction toward the seat section 16 such that the sliding frame 48 is caused to move upwardly along the pivot frame 18. In this position, the inner member 72 of the telescoping members 66, 68 is fully retracted within the outer member 70.

FIG. 7 illustrates the back section 20 in a fully upright position to define a sitting position with examination table 10. In this position, the linear actuator 44 is fully extended, and the coupling member 58 is rotated to orient the telescoping members 66, 68 at an angle extending toward the head end of the back section 20 with the inner members 72 extending from the outer members 70 to accommodate the upward movement of the sliding frame 48 relative to the pivot frame 18. Thus, as the back section 20 is pivoted upwardly, the sliding frame 48 concurrently moves upwardly to accommodate movement of a patient's back relative to the pivot frame 18.

It should also be noted that the frame 14 for the seat section 16 is attached to an extension 86 of the base member 12 at a pivot point 88, and a linear actuator 90 extends through the base 12 to a hinge point 92 with the seat frame 14. Thus, the actuator 90 may be operated to pivot the seat section 16 upwardly about the pivot connection 88 to provide a desired reclined orientation for the patient support surface of the examination table 10. In addition, an actuator 94 (FIG. 4) is also provided in the preferred embodiment to actuate the leg section 24 in pivotal movement relative to the seat section 16.

Referring further to FIGS. 1–4, the arm rests 28, 30 are mounted to support members 96, 98, respectively, which extend to mounting points at either end of the rotatable shaft 60, such as at the end adjacent bearing 62 in FIG. 4. Thus, the support members 96, 98 and associated arm rests 28, 30 pivot relative to the back section 20 as the back section 20 pivots relative to the seat section 16. The pivotal movement of the support members 96, 98 enables the arm rests 28, 30 to remain substantially horizontal, parallel to the seat section 16, and to move vertically in movement corresponding to that of a patient supported on the table 10 throughout movement of the back section 20.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An examination table comprising:

a base member;

a seat section supported on said base member;

a back section including an elongated pivot frame and a sliding frame;

a hinge connection connecting said pivot frame to said seat section for movement of said back section from a substantially horizontal position, parallel to said set section, to an inclined position;

a coupling member supported on said pivot frame and including a first portion connected to said sliding frame and a second portion connected to said seat section wherein said coupling member is supported for rotational movement about a pivot point on said pivot frame;

an actuator connected between said seat section and said back section; and wherein actuation of said actuator pivots said back section about said hinge connection causes rotation of said coupling member relative to said pivot frame and causes said sliding frame to move longitudinally along said pivot frame.

2. The examination table of claim 1 including arm rests located on either side of said back section wherein said arm rests pivot during pivotal movement of said back section whereby said arm rests are maintained in a generally horizontal position for different inclined positions of said back section.

3. The examination table of claim 2 wherein said arm rests are supported on said coupling member for rotational movement about said pivot point.

4. The examination table of claim 1 wherein said first portion of said coupling member comprises a telescoping member extending between said pivot point and said sliding frame.

5. The examination table of claim 1 wherein said first and second portions define spaced members extending radially from said pivot point, and including a linkage rod extending from a radially outer end of said second portion to an attachment location on said seat section.

6. The examination table of claim 5 wherein said first portion of said coupling member comprises a telescoping member extending between said pivot point and said sliding frame.

7. The examination table of claim 1 including an actuator connected between said seat section and said pivot frame wherein actuation of said actuator causes pivotal movement of said back section relative to said seat section and simultaneous movement of said sliding frame relative to said pivot frame.

8. An examination table comprising:

a base member;

a seat section supported on said base member;

a back section including an elongated pivot frame and a sliding frame;

a hinge connection connecting said pivot frame to said seat section;

an actuator connected between said seat section and said pivot frame wherein actuation of said actuator causes pivotal movement of said back section relative to said seat section; and including a linkage structure connecting said seat section to said sliding frame wherein pivotal movement of said back section causes movement of said linkage structure relative to said pivot frame, and thereby causes sliding movement of said sliding frame relative to said pivot frame.

9. The examination table of claim 8 wherein said linkage structure comprises a coupling member supported on said pivot frame wherein said coupling member is supported for rotational movement about a pivot point on said pivot frame.

10. The examination table of claim 9 wherein said linkage structure includes a telescoping member extending between said pivot point and said sliding frame.

11. The examination table of claim 9 wherein said coupling member comprises first and second portions spaced from each other and extending radially outwardly from said pivot point, said first portion extending to a connection with said sliding frame, and said linkage structure including a linkage rod extending from a radially outer end of said second portion to an attachment point on said seat section.

12. The examination table of claim 11 wherein said first portion of said coupling member comprises a telescoping member extending between said pivot point and said sliding frame.

13. The examination table of claim 8 including arm rests located on either side of said back section, said arm rests being mounted to said linkage structure.

14. The examination table of claim 13 wherein said arm rests pivot relative to said back section in response to pivotal movement of said back section whereby said arm rests are maintained in a substantially constant orientation relative to said seat section.

15. An examination table comprising:

base member;

a seat section supported on said base member;

a back section including an elongated pivot frame and a sliding frame;

a hinge connection connecting said pivot frame to said seat section;

a coupling member mounted for rotatable movement about a pivot point on said pivot frame and including a telescoping member having opposing ends, said opposing ends connected to said sliding frame and adjacent said pivot point, respectively; and wherein said sliding frame moves longitudinally along said pivot frame in response to said back section pivoting about said hinge connection.

16. The examination table of claim 15 including a linkage extending between said coupling member and said seat section, said linkage causing said coupling member to rotate in response to movement of said pivot frame relative to said seat section.

17. The examination table of claim 15 including arm rests supported on said coupling member wherein said arm rests rotate in response to movement of said pivot frame relative to said seat section.

* * * * *